US007527227B1

(12) United States Patent
Mondello

(10) Patent No.: US 7,527,227 B1
(45) Date of Patent: May 5, 2009

(54) HOSE GUIDING IMPLEMENT AND ASSOCIATED METHOD

(76) Inventor: Thomas R. Mondello, 5037 W. Herbert Ct., Monee, IL (US) 60449

( * ) Notice: Subject to any disclaimer, the term of this patent is extended or adjusted under 35 U.S.C. 154(b) by 120 days.

(21) Appl. No.: 11/699,962

(22) Filed: Jan. 30, 2007

Related U.S. Application Data

(60) Provisional application No. 60/763,183, filed on Jan. 30, 2006.

(51) Int. Cl.
*A62C 13/76* (2006.01)

(52) U.S. Cl. ..... 248/75; 242/615.2

(58) Field of Classification Search ..... 248/75, 248/87, 80, 83; 242/615.2
See application file for complete search history.

(56) References Cited

U.S. PATENT DOCUMENTS 2,618,465 A * 11/1952 Austin, Jr. ..... 242/615.2
2,974,933 A * 3/1961 Belanger ..... 242/615
3,829,065 A 8/1974 Less
5,549,262 A 8/1996 Whitehead
6,332,595 B1 * 12/2001 Klucznik ..... 248/87
6,595,464 B2 7/2003 Peck
2001/0028021 A1 * 10/2001 Martin ..... 248/87

FOREIGN PATENT DOCUMENTS

DE 4237949 A1 * 5/1994

* cited by examiner

*Primary Examiner*—Ramon O Ramirez

(57) ABSTRACT

A hose-guiding implement includes a first body with a solid core and a mating portion extending upwardly therefrom. The first body further has a disc-shaped shoulder protruding outwardly therefrom with a planar top surface registered orthogonal to a longitudinal length thereof. A first roller is removably positioned about the first body and rested on the shoulder, and has an axial bore extending along a length thereof. The first roller has an outer diameter equal to an outer diameter of the shoulder. A top member is removably interfitted with the mating portion of the first body and spaced above the first roller such that the first roller is vertically displaced along the longitudinal length of the first body when the hose slidably glides therealong such that the hose is allowed to glide along an outer surface of the first roller during operating conditions.

15 Claims, 4 Drawing Sheets

HOSE GUIDING IMPLEMENT AND ASSOCIATED METHOD

CROSS REFERENCE TO RELATED APPLICATIONS

This application claims the benefit of U.S. Provisional Application No. 60/763,183, filed Jan. 30, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to guides and, more particularly, to a hose-guiding implement and associated method for channeling a hose along a non-linear passageway during gardening activities.

2. Prior Art

Gardening and landscaping are important and satisfying aspects of home ownership for both men and women. As these activities allow people to use both the intellect and physical strength, they can contribute different talents to creating something that is both tangible and enjoyable. Whether bordering a home with a vibrant collection of floral beauties, pruning hedges to alluring and intricate shapes, fashioning a vegetable garden to supply fresh foods, or simply mowing a lawn to attractive precision, lawn and garden enthusiasts find joy, relaxation, and a sense of accomplishment in improving the outside appearance of a home.

As many homeowners will attest, perhaps the most important step in lawn and garden maintenance is to ensure that grass and plants receive plenty of hydrating Water. Those who do not wish to depend on chances of rainfall, or those who live in perpetually dry areas, usually tend to watering needs themselves by manually spraying the greenery with a water hose. While this is an effective means of infusing thirsty yards and flowers with much needed water, this method can prove laborious and time consuming. Particularly, guiding a heavy water hose over and through lawns and gardens is fraught with challenges. Not only does the user have to constantly straighten the hose to keep water flow unobstructed, but the long and unwieldy source of water can be difficult to navigate without causing damage to existing flower beds and bushes. As a result, a relaxing outdoor activity such as gardening can become exhausting, tiresome, and frustrating before the task is complete.

One prior art example shows a preferably unitary plastic hose guide for guiding a hose mounted on a building above the ground so that a hose is lifted high enough to avoid contact with obstacles located on the ground adjacent a building while being deployed and used. In one embodiment, an elongated guide member has a J-shaped curved trough for retaining a hose placed in it. The trough has downwardly curved entrance and exit lips to facilitate hose movement into and out of the trough. The lip of the J-shape retains the hose in the trough by preventing the weight of the hose from dragging the hose outwardly and downwardly out of the trough, while readily permitting lifting of the hose out of the trough when desired. A mounting bracket spaces the guide member from the building where it is removably secured by headed fasteners.

In another embodiment, the unitary plastic guide has a semi-circular trough with a generally C-shaped cross section to direct the hose around a corner of the building. The hose is retained by one protrusion extending upwardly from the extended lower lip of the C-shape to retain the hose within the trough during hose movement. Headed fasteners on the building cooperate with keyhole-shaped slots to removably mount the hose guide on the corner of the building. Unfortunately, this prior art example does not assist a user to guide a hose along a ground surface during operating conditions.

Another prior art example shows a retractable hose guide for guiding a hose through and around gardens, flowerbeds and other yard emplacements. The retractable hose guide is permanently placed in the ground. It overcomes the problems of being a permanent obstacle in the yard, of being susceptible to damage, of having to be removed after each use, or of presenting a safety hazard. A hose may be moved freely around the yard, being guided by the retractable hose guide, thus avoiding damage either to the hose or to the landscaping. The retractable hose guide is placed in the stored position by pressing on the cover by hand or foot, compressing the spring and allowing the spool to be hidden in the body. The retractable hose guide is secured in place by engaging bayonet tabs into bayonet sockets by a simple twist of the cover by hand or foot. Unfortunately, this prior art example does not allow a user to define a predetermined travel path of a hose using removable bodies to guide the hose. In addition, a smaller user may not be able to position the entire apparatus as needed when not in use.

Accordingly, a need remains for a hose-guiding implement and associated method in order to overcome the above-noted shortcomings. The present invention satisfies such a need by providing a system that is convenient and easy to use, is lightweight yet durable in design, and allows a user to channel a hose along a non-linear passageway during gardening activities. Such an apparatus provides gardeners with a simple and effective means of managing water hoses while tending to lawns and other vegetation. The apparatus helps to ease the difficult task of lugging a heavy hose all over a property. In addition, the apparatus helps to keep a hose straightened at all times, eliminating the need to interrupt the watering process to "un-kink" the hose. The present invention is inexpensive, easy to install, and designed for many years of repeated use.

BRIEF SUMMARY OF THE INVENTION

In view of the foregoing background, it is therefore an object of the present invention to provide an apparatus for a hose-guiding implement and associated method. These and other objects, features, and advantages of the invention are provided by a hose-guiding implement for channeling a hose along a non-linear passageway during gardening activities.

The apparatus includes a first rectilinear body that has a solid core member and a mating portion effectively extending upwardly from an uppermost top end of the first body. Such a first body further has a disc-shaped shoulder advantageously protruding outwardly therefrom. Such a shoulder has a planar top surface conveniently registered orthogonal to a longitudinal length of the first body. Such a core member has a chamfered bottom end effectively defining a beveled tip removably positional into a ground surface for advantageously preventing a bottom end of the first body from prematurely breaking during extending use.

The apparatus further includes a first tubular roller removably positioned about the first body and rested directly on the top surface of the shoulder. The first roller has an axial bore extending along an entire longitudinal length thereof such that the first roller is simultaneously adapted along and about the longitudinal length of the first body respectively, and is freely rotatable about the first body. The first roller has an outer diameter equal to an outer diameter of the shoulder such that the hose is effectively prohibited from engaging the top surface of the shoulder and undesirably penetrating between a bottom surface of the first roller and the top surface of the shoulder. The first roller is linearly displaced along a first linear path effectively defined intermediately of the shoulder and the mating portion respectively.

The apparatus further includes, in an alternate embodiment, a top member removably interfitted with the mating portion of the first body and advantageously spaced above the first roller such that the first roller is vertically displaced along the longitudinal length of the first body when the hose slidably glides therealong such that the hose is conveniently allowed to glide along an outer surface of the first roller during operating conditions.

The apparatus further includes a second rectilinear body coextensively shaped with the first body that has a mating portion monolithically formed with an uppermost end thereof. Such a first body is oriented parallel to the second body. The top member has a linear central region and is further provided with curvilinear opposed ends effectively defining corresponding mating portions formed therein. Such mating portions of the top member are directly and removably engaged with the mating portions of the first and second bodies respectively such that the top member is advantageously registered orthogonal to the first and second bodies while spanning therebetween.

The apparatus further includes second and third tubular rollers rotatably positioned about the second body and the top member respectively such that the hose is conveniently guided along outer surfaces of the first, second and third rollers when positioned between the first and second bodies and beneath the top member.

The mating portions of the first and second bodies include male couplings conveniently provided with outwardly beveled top flanges. The top member includes coextensively shaped and oppositely disposed female portions provided with corresponding notches formed therein such that the top flanges effectively fit within the notches when the male couplings and the female portions are engaged respectively. Such female portions are located at leftmost and rightmost ends of the top member.

A method for channeling a hose along a non-linear passageway during gardening activities includes the steps of providing a first rectilinear body with a solid core and a mating portion extending upwardly from an uppermost top end of the first body. Such a first body has a disc-shaped shoulder protruding outwardly therefrom. The shoulder has a planar top surface registered orthogonal to a longitudinal length of the first body.

The method further includes the steps of removably positioning a first tubular roller about the first body and resting the first tubular roller directly on the top surface of the shoulder. Such a roller is freely rotatable about the body. The first roller has an outer diameter equal to an outer diameter of the shoulder such that the hose is prohibited from engaging the top surface of the shoulder and undesirably penetrating between a bottom surface of the first roller and the top surface of the shoulder.

The method further includes, in an alternate embodiment, the steps of removably interfitting a top member with the mating portion of the first body and spacing the top member above the first roller such that the first roller is vertically displaced along the longitudinal length of the first body when the hose slidably glides therealong such that the hose is allowed to glide along an outer surface of the first roller during operating conditions. The first roller has an axial bore extending along an entire longitudinal length thereof such that the first roller is simultaneously adapted along and about the longitudinal length of the first body respectively.

The method further includes the steps of linearly displacing the first roller along a first linear path defined intermediately of the shoulder and the mating portion respectively, and statically anchoring a solid core member inside of the first body. Such a core member has a chamfered bottom end defining a beveled tip removably positional into a ground surface for preventing a bottom end of the first body from prematurely breaking during extending use.

The method further includes the steps of providing a second rectilinear body coextensively shaped with the first body. Such a second body has a mating portion monolithically formed with an uppermost end thereof. The first body is oriented parallel to the second body. The top member has a linear central region and is further provided with curvilinear opposed ends defining corresponding mating portions formed therein. Such mating portions of the top member are directly and removably engaged with the mating portions of the first and second bodies respectively such that the top member is registered orthogonal to the first and second bodies while spanning therebetween.

The method further includes the steps of providing second and third tubular rollers by rotatably positioning the second and third tubular rollers about the second body and the top member respectively such that the hose is guided along outer surfaces of the first, second and third rollers when positioned between the first and second bodies and beneath the top member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
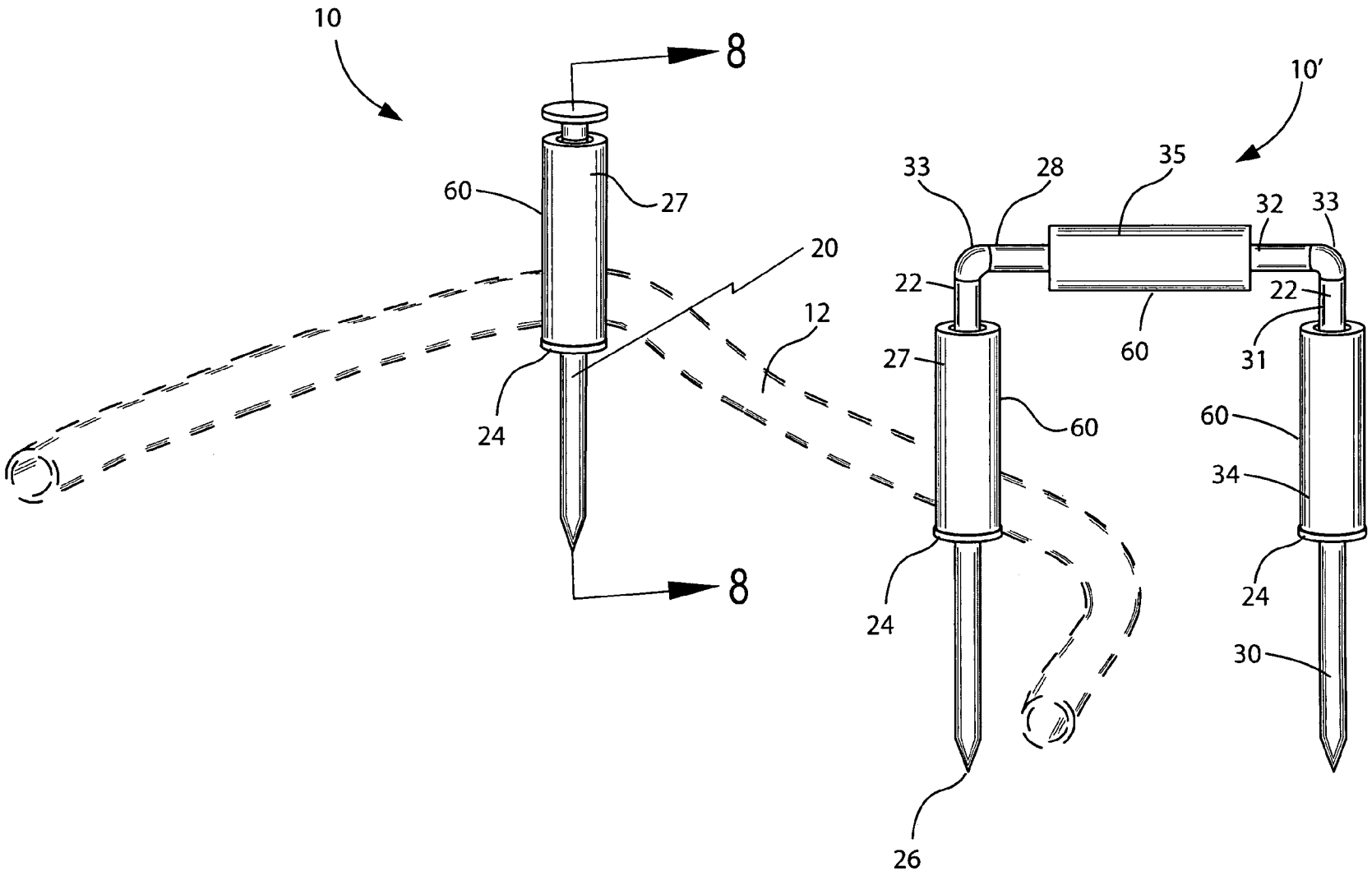
FIG. 1 is a perspective view of the apparatus showing preferred and alternate embodiments respectively with a hose being channeled thereabout, in accordance with the present invention.
Figure 3:
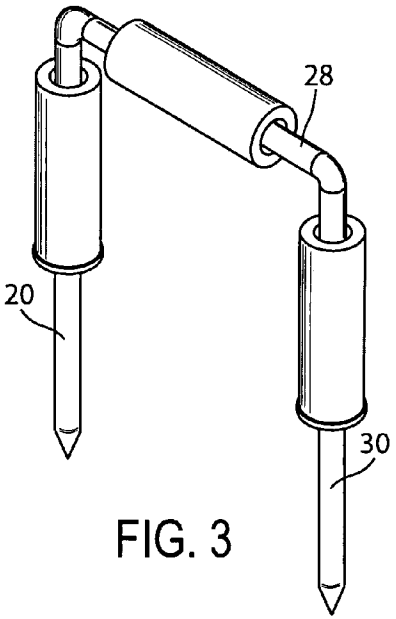
FIG. 3 is perspective view of the apparatus shown in FIG. 2.
Figure 5:
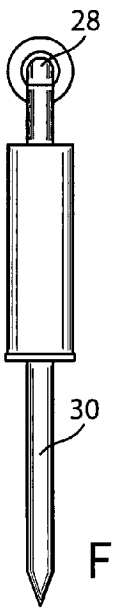
FIG. 5 is a side elevational view of the apparatus shown in FIG. 4.
Figure 2:
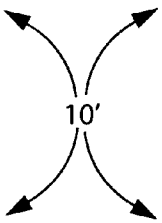
FIG. 2 is a top plan view of the alternate embodiment shown in FIG. 1.
Figure 2:
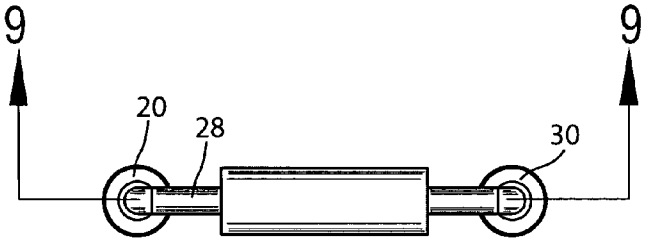
Figure 4:
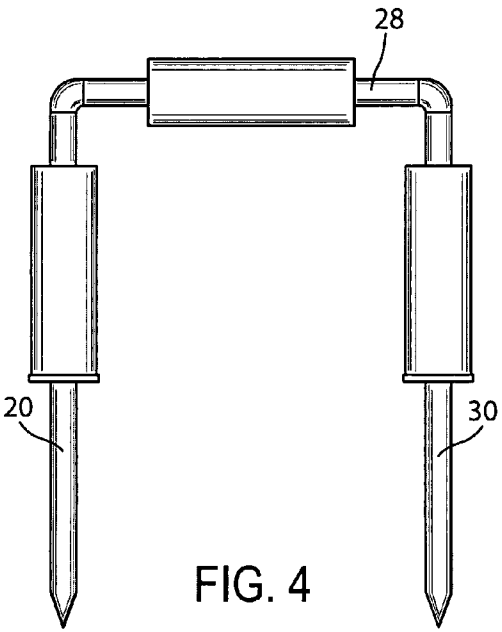
FIG. 4 is a front elevational view of the apparatus shown in FIG. 3.
Figure 6:
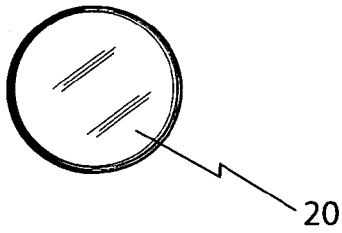
FIG. 6 is a top plan view of the first body in a preferred embodiment.
Figure 7:
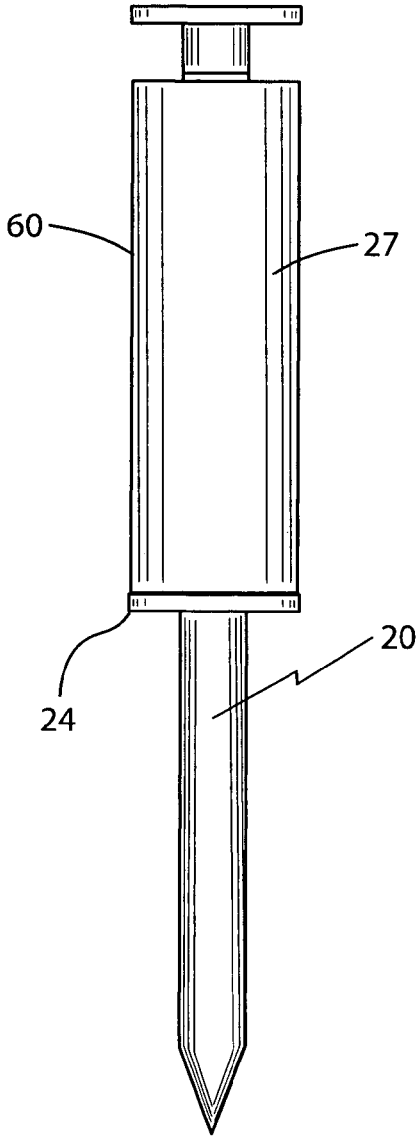
FIG. 7 is a side elevational view of the first body shown in FIG. 6.
Figure 8:
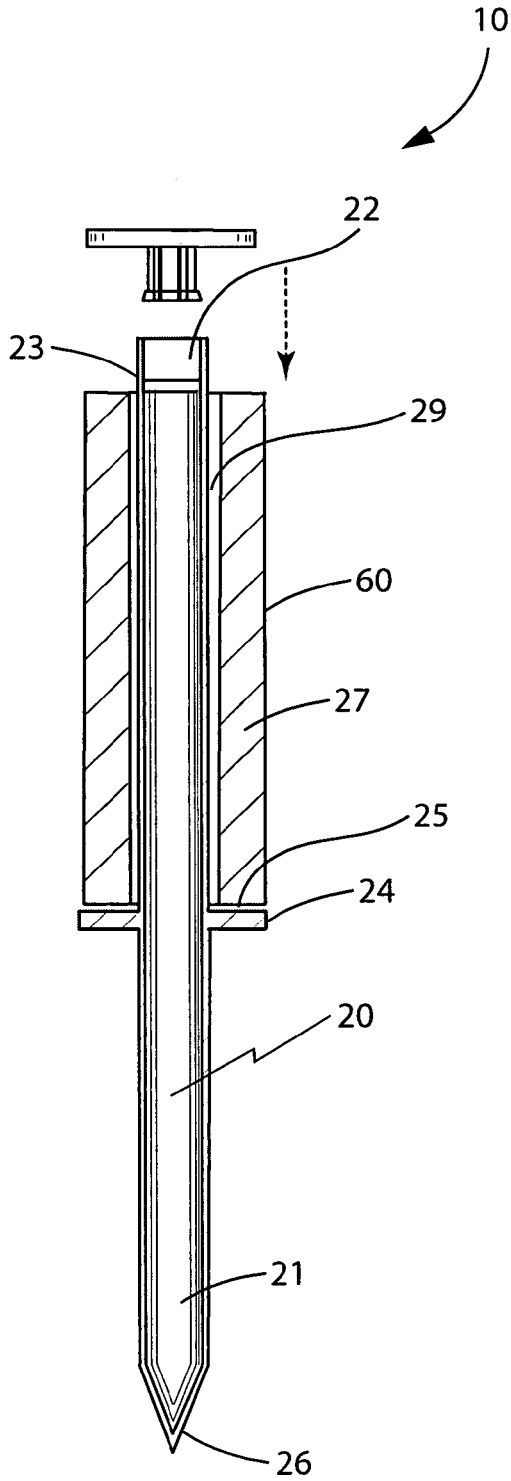
FIG. 8 is a cross sectional view of the first body shown in FIG. 1, taken along line 8-8.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus and method of this invention are referred to generally in FIGS. 1-9 by the reference numeral 10 and 10' and is intended to provide a hose-guiding implement and associated method. It should be understood that the apparatus and method 10 and 10' may be used to guide many different types of linear hose-like materials and should not be limited in use to guiding only those types of materials described herein.

Referring initially to FIGS. 1, 6, 7 and 8, the apparatus 10, in a preferred embodiment, includes a first rectilinear body 20 that has a solid core member 21 and a mating portion 22 extending upwardly from an uppermost top end 23 of the first body 20. Such a first body 20 further has a disc-shaped shoulder 24 advantageously protruding outwardly therefrom for preventing the first body 20 from being inserted too far into a ground surface during operating conditions. Such a shoulder 24 has a planar top surface 25 registered orthogonal to a longitudinal length of the first body 20. Such a core member 21 has a chamfered bottom end defining a beveled tip 26 removably positional into a ground surface for advantageously preventing a bottom end of the first body 20 from prematurely breaking during extending use. The core member 21 allows the first body 20 to penetrate hard ground surfaces without breaking, and remain positioned therein, without compromising the ability of the first body 20 to guide a hose 12 drawn thereabout.

Again referring to FIGS. 1, 6, 7 and 8, the apparatus 10 further includes a first tubular roller 27 removably positioned about the first body 20 and rested directly on the top surface 25 of the shoulder 24, without the use of intervening elements. The first roller 27 has an axial bore 29 extending along an entire longitudinal length thereof, which is essential such that the first roller 27 is simultaneously adapted along and about the longitudinal length of the first body 20 respectively, and is freely rotatable about the first body 20. The first roller 27 allows a hose 12 to be drawn about the first body 20 without damaging the hose 12 as a result of friction, thereby extending the useful life of the hose 12. The first roller 27 has an outer diameter equal to an outer diameter of the shoulder 24, which is critical such that the hose 12 is prohibited from engaging the top surface 25 of the shoulder 24 and undesirably penetrating between the first roller 27 and the top surface 25 of the shoulder 24. The diameters of the first roller 27 and the shoulder 24 prevent a hose 12 from being undesirably captured and contained between the first roller 27 and the shoulder 24 and thereby preventing the hose 12 from being pulled about the first body 20 during operating conditions. The first roller 27 is linearly displaced along a first linear path defined intermediately of the shoulder 24 and the mating portion 22 respectively.

Referring to FIGS. 1, 2, 3, 4, 5 and 9, the apparatus 10' further includes, in an alternate embodiment, a top member 28 removably interfitted with the mating portion 22 of the first body 20 and advantageously spaced above the first roller 27, which is crucial such that the first roller 27 is vertically displaced along the longitudinal length of the first body 20 when the hose 12 slidably glides therealong, which is vital such that the hose 12 is allowed to glide along an outer surface 60 of the first 27 roller during operating conditions. The top member 28 can be attached or detached as desired by a user based on the need to fully encase a hose 12 within the apparatus 10'.

Again referring to FIGS. 1, 2, 3, 4, 5 and 9, the apparatus 10' further includes a second rectilinear body 30 coextensively shaped with the first body 20 that has a mating portion 22 monolithically formed with an uppermost end 31 thereof. Such a first body 20 is oriented parallel to the second body 30. The top member 28 has a linear central region 32 and is further provided with curvilinear opposed ends 33 defining corresponding mating portions 22 formed therein. Such mating portions 22 of the top member 28 are directly and removably engaged with the mating portions 22 of the first 20 and second 30 bodies respectively, without the use of intervening elements, such that the top member 28 is advantageously registered orthogonal to the first and second bodies 20, 30 while spanning therebetween. Such a combination of the bodies 20, 30 and the top member 28 contain the hose 12 within the apparatus 10' and serves as a guide for the placement of the hose 12 by the user.

Still referring to FIGS. 1, 2, 3, 4, 5 and 9, the apparatus 10' further includes second 34, and third 35 tubular rollers rotatably positioned about the second body 30 and the top member 28 respectively, which is important such that the hose 12 is guided along outer surfaces 60 of the first, second and third rollers 27, 34, 35 when positioned between the first and second bodies 20, 30 and beneath the top member 28.

Figure 9:
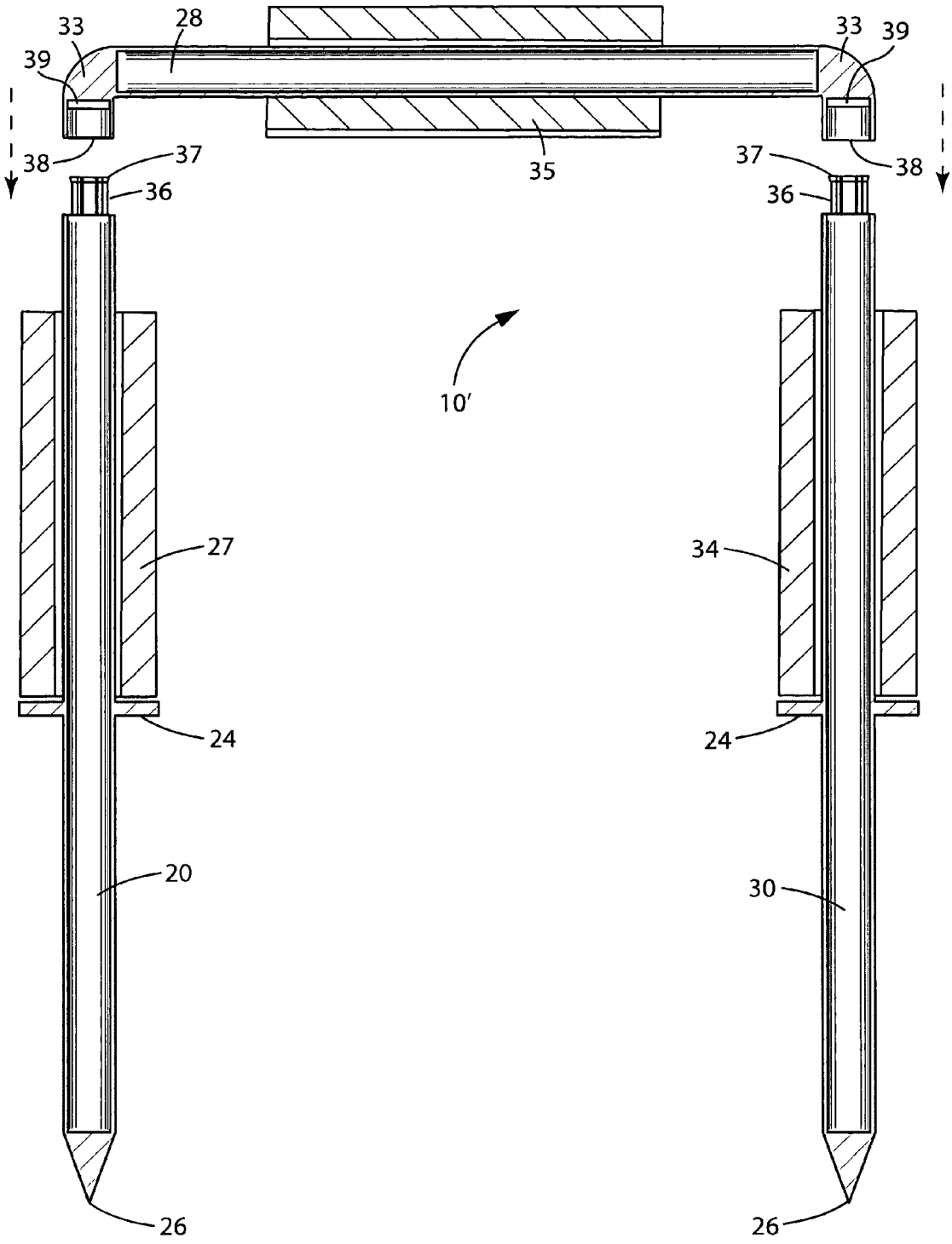
FIG. 9 is a cross sectional view of the apparatus shown in FIG. 2, taken along line 9-9.

Referring to FIG. 9, the mating portions 22 of the first and second bodies 20, 30 include male couplings 36 provided with outwardly beveled top flanges 37. The top member 28 includes coextensively shaped and oppositely disposed female portions 38 provided with corresponding notches 39 formed therein, which is essential such that the top flanges 37 fit within the notches 39 when the male couplings 36 and the female portions 38 are engaged respectively. Such female portions 38 are located at leftmost and rightmost ends of the top member 28. The male couplings 36 and female portions 38 allow a user to selectively combine the bodies 20, 30 with the top member 28 as desired.

In use, a user first purchases a plurality of bodies 20, 30 and top members 28 based on the size of a property. Next, the user places the bodies 20, 30 at opposed corners of the area to be watered by inserting the body 20, 30 into a ground surface such that the shoulder 24 rests flush with the ground surface. If desired, a user can then attach the top member 28 to the bodies 20, as necessary. The user then unwinds a hose 12 and inserts the hose 12 through the open area in the center of the bodies 20, 30. As the hose 12 is taken through the apparatus 10, 10', the rollers 27, 34, 35 propel the hose 12 along, alleviating some of the dragging burden. At the same time, the bodies 20, and the top member 28 keep the hose 12 confined within the open area such that the hose 12 is not dragged over existing vegetation. After use, the bodies 20, 30 and the top member 28 can be easily removed from the ground surface and stored until needed again.

The ability to mate a top member 28 with the bodies 20, 30 provides the unexpected benefit of allowing a user to channel a hose 12 through the open area without having the hose 12 undesirably disengage from the bodies 20, 30 and the top member 28. In addition, the rollers 27, 34, 35 provide a means of alleviating some of the burden of dragging a hose 12 along an extended ground surface. Also, the removability of the bodies 20, 30 and the top member 28 allows a user to place the bodies 20, 30 and the top member 28 in alternative positions based on need, as well as remove them from a ground surface altogether. The above mentioned benefits overcome the previously noted prior art shortcomings.

In a preferred method of operation, a method 10 for channeling a hose 12 along a non-linear passageway during gardening activities includes the steps of providing a first rectilinear body 20 with a solid core 21 and a mating portion 22 extending upwardly from an uppermost top end 23 of the first body 20. Such a first body 20 has a disc-shaped shoulder 24 protruding outwardly therefrom. The shoulder 24 has a planar top surface 25 registered orthogonal to a longitudinal length of the first body 20.

The method 10 further includes the steps of removably positioning a first tubular roller 27 about the first body 20 and resting the first roller 27 directly on the top surface 25 of the shoulder 24, without the use of intervening elements. Such a first roller 27 is freely rotatable about the body 20. The first roller 27 has an outer diameter equal to an outer diameter of the shoulder 24, which is essential such that the hose 12 is prohibited from engaging the top surface 25 of the shoulder 24 and undesirably penetrating between the first roller 27 and the top surface 25 of the shoulder 24.

The method 10' further includes, in an alternate embodiment, the steps of removably interfitting a top member 28 with the mating portion 22 of the first body 20 and spacing the top member 28 above the first roller 27, which is critical such that the first roller 27 is vertically displaced along the longitudinal length of the first body 20 when the hose 12 slidably glides therealong, which is crucial such that the hose 12 is allowed to glide along an outer surface 60 of the first roller 27 during operating conditions. The first roller 27 has an axial bore 29 extending along an entire longitudinal length thereof, which is vital such that the first roller 27 is simultaneously adapted along and about the longitudinal length of the first body 20 respectively.

The method 10' further includes the steps of linearly displacing the first roller 27 along a first linear path defined intermediately of the shoulder 24 and the mating portion 22 respectively, and statically anchoring the solid core member 21 inside of the first body 20. Such a core member 21 has a chamfered bottom end defining a beveled tip 26 removably positional into a ground surface for preventing a bottom end of the first body 20 from prematurely breaking during extending use.

The method 10' further includes the steps of providing a second rectilinear body 30 coextensively shaped with the first body 20. Such a second body 30 has a mating portion 22 monolithically formed with an uppermost end 31 thereof. The first body 20 is oriented parallel to the second body 30. The top member 28 has a linear central region 32 and is further provided with curvilinear opposed ends 33 defining corresponding mating portions 22 formed therein. Such mating portions 22 of the top member 28 are directly and removably engaged with the mating portions 22 of the first and second bodies 20, 30 respectively, without the use of intervening elements, which is necessary such that the top member 28 is registered orthogonal to the first and second bodies 20, 30 while spanning therebetween.

The method 10' further includes the steps of providing second 34 and third 35 tubular rollers by rotatably positioning the second and third tubular rollers 34, 35 about the second body 30 and the top member 28 respectively, which is essential such that the hose 12 is guided along outer surfaces 60 of the first, second and third rollers 27, 34, 35 when positioned between the first and second bodies 20, 30 and beneath the top member 28.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A hose-guiding implement for channeling a hose along a non-linear passageway during gardening activities, said hose-guiding implement comprising:

a first rectilinear body having a solid core and a mating portion extending upwardly from an uppermost top end of said first body, said first body further having a disc-shaped shoulder protruding outwardly therefrom, said shoulder having a planar top surface registered orthogonal to a longitudinal length of said first body;

a first tubular roller removably positioned about said first body and rested directly on said top surface of said shoulder, said roller being freely rotatable about said body;

a top member removably interfitted with said mating portion of said first body and spaced above said first roller such that said first roller is vertically displaced along the longitudinal length of said first body when the hose slidably glides therealong such that the hose is allowed to glide along an outer surface of said first roller during operating conditions; and a second rectilinear body coextensively shaped with said first body and having a mating portion monolithically formed with an uppermost end thereof, said first body being oriented parallel to said second body;

wherein said top member has a linear central region and is further provided with curvilinear opposed ends defining corresponding mating portions formed therein, said mating portions of said top member being directly and removably engaged with said mating portions of said first and second bodies respectively such that said top member is registered orthogonal to said first and second bodies while spanning therebetween;

wherein said first roller has an axial bore extending along an entire longitudinal length thereof such that said first roller is simultaneously adapted along and about the longitudinal length of said first body respectively.

2. The hose-guiding implement of claim 1, wherein said first roller is linearly displaced along a first linear path defined intermediately of said shoulder and said mating portion respectively.

3. The hose-guiding implement of claim 1, wherein said first body comprises:

a solid core member statically anchored inside of said first body, said core member having a chamfered bottom end defining a beveled tip removably positional into a ground surface for preventing a bottom end of said first body from prematurely breaking during extending use.

4. The hose-guiding implement of claim 1, further comprising:

second and third tubular rollers rotatably positioned about said second body and said top member respectively such that the hose is guided along outer surfaces of said first, second and third rollers when positioned between said first and second bodies and beneath said top member.

5. The hose-guiding implement of claim 4, wherein said mating portions of said first and second bodies comprise:

male couplings provided with outwardly beveled top flanges, said top member including coextensively shaped and oppositely disposed female portions provided with corresponding notches formed therein such that said top flanges fit within said notches when said male couplings and said female portions are engaged respectively, said female portions being located at leftmost and rightmost ends of said top member.

6. A hose-guiding implement for channeling a hose along a non-linear passageway during gardening activities, said hose-guiding implement comprising:

a first rectilinear body having a solid core and a mating portion extending upwardly from an uppermost top end of said first body, said first body further having a disc-shaped shoulder protruding outwardly therefrom, said shoulder having a planar top surface registered orthogonal to a longitudinal length of said first body;

a first tubular roller removably positioned about said first body and rested directly on said top surface of said shoulder, said roller being freely rotatable about said body, wherein said first roller has an outer diameter equal to an outer diameter of said shoulder such that the hose is prohibited from engaging said top surface of said shoulder and undesirably penetrating between a bottom surface of said first roller and said top surface of said shoulder;

a top member removably interfitted with said mating portion of said first body and spaced above said first roller such that said first roller is vertically displaced along the longitudinal length of said first body when the hose slidably glides therealong such that the hose is allowed to glide along an outer surface of said first roller during operating conditions; and a second rectilinear body coextensively shaped with said first body and having a mating portion monolithically formed with an uppermost end thereof, said first body being oriented parallel to said second body;

wherein said top member has a linear central region and is further provided with curvilinear opposed ends defining corresponding mating portions formed therein, said mating portions of said top member being directly and removably engaged with said mating portions of said first and second bodies respectively such that said ton member is registered orthogonal to said first and second bodies while spanning therebetween;

wherein said first roller has an axial bore extending along an entire longitudinal length thereof such that said first roller is simultaneously adapted along and about the longitudinal length of said first body respectively.

7. The hose-guiding implement of claim 6, wherein said first roller is linearly displaced along a first linear path defined intermediately of said shoulder and said mating portion respectively.

8. The hose-guiding implement of claim 6, wherein said first body comprises:

a solid core member statically anchored inside of said first body, said core member having a chamfered bottom end defining a beveled tip removably positional into a ground surface for preventing a bottom end of said first body from prematurely breaking during extending use.

9. The hose-guiding implement of claim 6, further comprising:

second and third tubular rollers rotatably positioned about said second body and said top member respectively such that the hose is guided along outer surfaces of said first, second and third rollers when positioned between said first and second bodies and beneath said top member.

10. The hose-guiding implement of claim 9, wherein said mating portions of said first and second bodies comprise:

male couplings provided with outwardly beveled top flanges, said top member including coextensively shaped and oppositely disposed female portions provided with corresponding notches formed therein such that said top flanges fit within said notches when said male couplings and said female portions are engaged respectively, said female portions being located at leftmost and rightmost ends of said top member.

11. A method for channeling a hose along a non-linear passageway during gardening activities comprises the steps of:

a. providing a first rectilinear body having a solid core and a mating portion extending upwardly from an uppermost top end of said first body, said first body further having a disc-shaped shoulder protruding outwardly therefrom, said shoulder having a planar top surface registered orthogonal to a longitudinal length of said first body;

b. removably positioning a first tubular roller about said first body and resting said first tubular roller directly on said top surface of said shoulder, said roller being freely rotatable about said body, wherein said first roller has an outer diameter equal to an outer diameter of said shoulder such that the hose is prohibited from engaging said top surface of said shoulder and undesirably penetrating between a bottom surface of said first roller and said top surface of said shoulder;

c. removably interfitting a top member with said mating portion of said first body and spacing said top member above said first roller such that said first roller is vertically displaced along the longitudinal length of said first body when the hose slidably glides therealong such that the hose is allowed to glide along an outer surface of said first roller during operating conditions; and d. providing a second rectilinear body coextensively shaped with said first body, said second body having a mating portion monolithically formed with an uppermost end thereof, said first body being oriented parallel to said second body;

wherein said top member has a linear central region and is further provided with curvilinear opposed ends defining corresponding mating portions formed therein, said mating portions of said top member being directly and removably engaged with said mating portions of said first and second bodies respectively such that said top member is registered orthogonal to said first and second bodies while spanning therebetween;

wherein said first roller has an axial bore extending along an entire longitudinal length thereof such that said first roller is simultaneously adapted along and about the longitudinal length of said first body respectively.

12. The method of claim 11, further comprising the steps of:

e. linearly displacing said first roller along a first linear path defined intermediately of said shoulder and said mating portion respectively.

13. The method of claim 11, further comprising the steps of:

e. statically anchoring a solid core member inside of said first body, said core member having a chamfered bottom end defining a beveled tip removably positional into a ground surface for preventing a bottom end of said first body from prematurely breaking during extending use.

14. The method of claim 11, further comprising the steps of:

e. providing second and third tubular rollers by rotatably positioning said second and third tubular rollers about said second body and said top member respectively such that the hose is guided along outer surfaces of said first, second and third rollers when positioned between said first and second bodies and beneath said top member.

15. The method of claim 14, wherein said mating portions of said first and second bodies comprise:

male couplings provided with outwardly beveled top flanges, said mating portions of said top member including oppositely disposed female portions provided with corresponding notches formed therein such that said top flanges fit within said notches when said male couplings and said female portions are engaged respectively, said female portions being located at leftmost and rightmost ends of said top member.

* * * * *